US005162789A

United States Patent [19]

Moriya et al.

[11] Patent Number: 5,162,789

[45] Date of Patent: Nov. 10, 1992

[54] FLUORESCENT INDICATOR APPARATUS

[75] Inventors: Mitutosi Moriya, West Bloomfield, Mich.; Koji Hasebe, Anjo, Japan; Tohru Kiuchi, Kariya, Japan; Nobuharu Kobayashi, Toyohashi, Japan

[73] Assignee: Nippondenso Co., Ltd., Kariya, Japan

[21] Appl. No.: 345,849

[22] Filed: May 1, 1989

[30] Foreign Application Priority Data

Apr. 30, 1988 [JP] Japan ..... 63-108519

[51] Int. Cl.[5] ..... G09G 3/00

[52] U.S. Cl. ..... 340/814; 340/811; 340/767

[58] Field of Search ..... 340/716, 717, 811, 758, 340/753, 754, 767, 701, 752, 756, 765, 812, 813, 814; 313/496, 497; 355/206, 209; 315/169.3, 169.1

[56] References Cited

U.S. PATENT DOCUMENTS

| | | | |
|---|---|---|---|
| 4,009,566 | 3/1977 | Ho | 340/765 |
| 4,122,444 | 10/1978 | Kitajima et al. | 340/790 |
| 4,241,294 | 12/1980 | Fisler | 340/767 |
| 4,322,758 | 3/1982 | Ohya et al. | 340/753 |
| 4,344,622 | 8/1982 | Nissim | 340/754 |
| 4,388,558 | 6/1983 | Ande et al. | 358/161 |
| 4,603,962 | 8/1986 | Dekura | 355/209 |
| 4,682,228 | 6/1983 | Mizuno et al. | 315/77 |
| 4,764,766 | 8/1988 | Anyama et al. | 340/784 |

FOREIGN PATENT DOCUMENTS

| | | |
|---|---|---|
| 58-220179 | 12/1983 | Japan . |
| 59-763 | 1/1984 | Japan . |
| 61-57988 | 3/1986 | Japan . |
| 61-177487 | 8/1986 | Japan . |

*Primary Examiner*—Jeffery A. Brier
*Assistant Examiner*—Regina Liang
*Attorney, Agent, or Firm*—Cushman, Darby & Cushman

[57] ABSTRACT

A fluorescent indicator apparatus comprises a first fluorescent display section including a plurality of grids, and anode segments corrsponding to the respective grids. A first driving device serves to drive the grids and the anode segments of the first fluorescent display section in a time-division manner to allow the anode segments of the first fluorescent display section to emit light. A second fluorescent display section includes a grid and an anode segment. A second driving device connected to the first driving device serves to drive the grid and the anode segment of the second fluorescent display section in synchronism with at least one of time-divided parts of the time-division drive of the first fluorescent display section to allow the anode of the second fluorescent display section to emit light.

6 Claims, 6 Drawing Sheets

SEGMENT DECODER DRIVER
BKN
GRID CONTROL CKT
SYNC CONTROL CKT
VOLT REG.
MICRO-COMPUTER
CPU
A/D
SIGNAL A
SIGNAL B
TO DRIVERS 2, 5a, 5b
LIGHTING SIG.
SENSOR GROUP
DIM SIG.
+5V
-30V
-24.6V
12V

FLUORESCENT INDICATOR APPARATUS

BACKGROUND OF THE INVENTION

1. Field of the Invention

This invention relates to a fluorescent indicator apparatus.

2. Description of the Prior Art

Japanese published unexamined patent application 61-177487 corresponding to U.S. Pat. No. 4,764,766 discloses a drive system for a liquid crystal display apparatus which includes a dot-matrix display section and a fixed-pattern display section. The dot-matrix display section is driven in a time division manner. In order to maintain an adequate contrast of the fixed-pattern display section, the fixed-pattern display section is subjected to a static drive independent of the time-division drive of the dot-matrix display section.

Japanese published unexamined patent application 58-220179 discloses a multi-color fluorescent indicator apparatus which includes indicator sections of different colors. The indicator sections are subjected to a dynamic drive. For human eyes, a desirable contrast generally depends on color. In order to compensate such a variation of desirable contrast, the indicator sections of the different colors are driven by signals having different duty factors respectively.

SUMMARY OF THE INVENTION

It is an object of this invention to provide an excellent fluorescent indicator apparatus.

In accordance with a general aspect of this invention, a fluorescent indicator apparatus comprises a first fluorescent display section including a plurality of grids, and anode segments corresponding to the respective grids. A first driving device serves to drive the grids and the anode segments of the first fluorescent display section in a time-division manner to allow the anode segments of the first fluorescent display section to emit light. A second fluorescent display section includes a grid and an anode segment. A second driving device connected to the first driving device serves to drive the grid and the anode segment of the second fluorescent display section in synchronism with at least one of time-divided parts of the time-division drive of the first fluorescent display section to allow the anode of the second fluorescent display section to emit light.

DESCRIPTION OF THE PREFERRED EMBODIMENT

Figure 1:
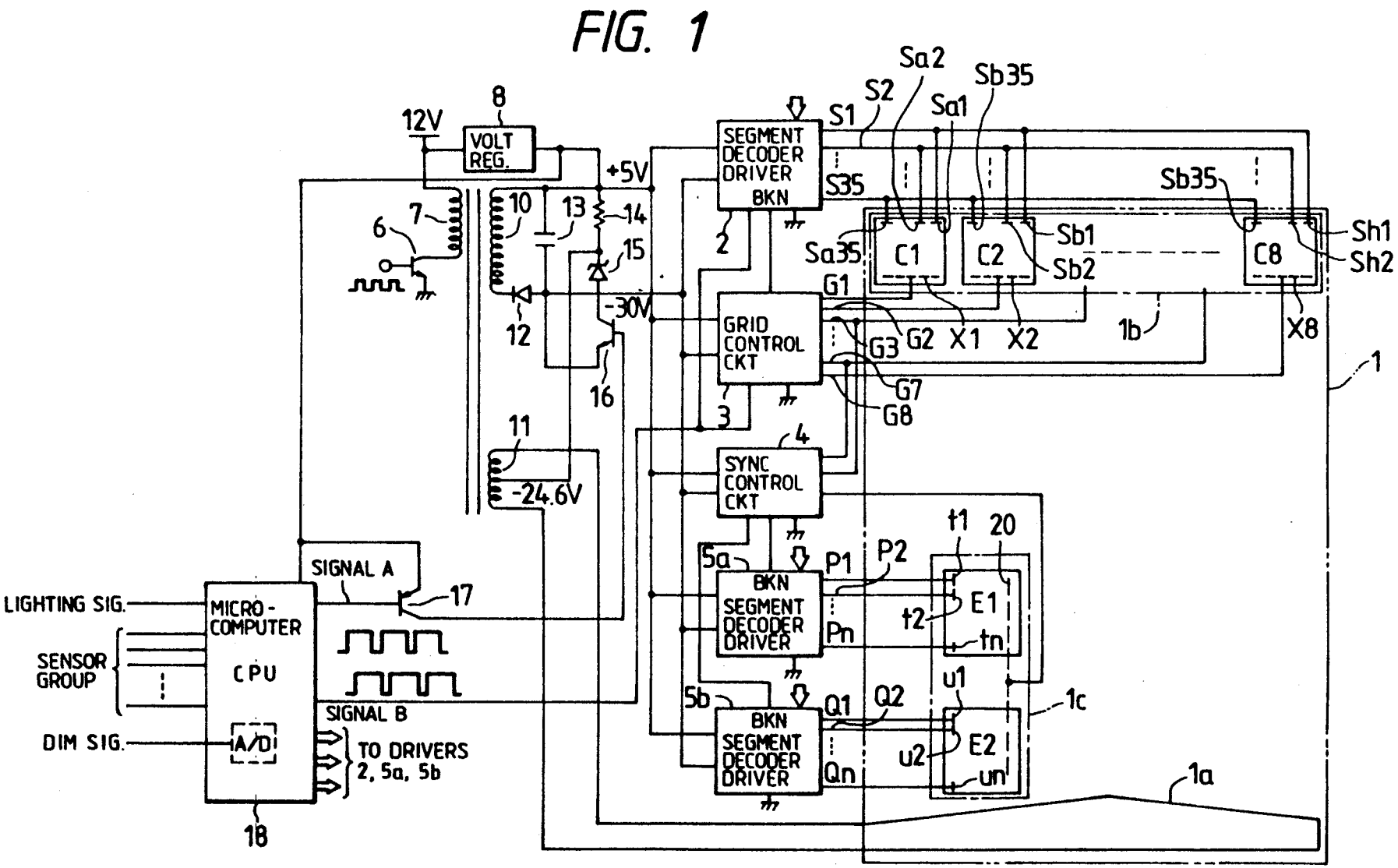
FIG. 1 is a diagram of a fluorescent indicator apparatus according to an embodiment of this invention.

With reference to FIG. 1, a fluorescent indicator tube 1 includes a filament 1*a*, a character display section 1*b*, and a graphic display section 1*c*. The character display section 1*b* has eight dot matrixes C1–C8 of a 5 by 7 type which are driven in a time division manner. The graphic display section 1*c* is driven in synchronism with the time-division drive of the character display section 1*b*. Each of the dot matrixes C1–C8 includes a grid (X1, X2, . . . , X8) and thirty five anode segments (Sa1, Sa2, . . . , Sa35, Sb1, Sb2, . . . , Sb35, . . . , Sh1, Sh2, . . . , Sh35). The graphic display section 1*c* includes an R/B light emitting portion E1 generating red brown light and an B/G light emitting portion E2 generating blue green light. The luminous efficiency of the R/B portion E1 is lower than that of the B/G portion E2. The luminous efficiency of the B/G portion E2 is substantially equal to that of the dot matrixes C1–C8 of the character display section 1*b*.

The character display section 1*b* constitutes a first fluorescent indicator section, while the graphic display section 1*c* constitutes a second fluorescent indicator section.

Figure 2:
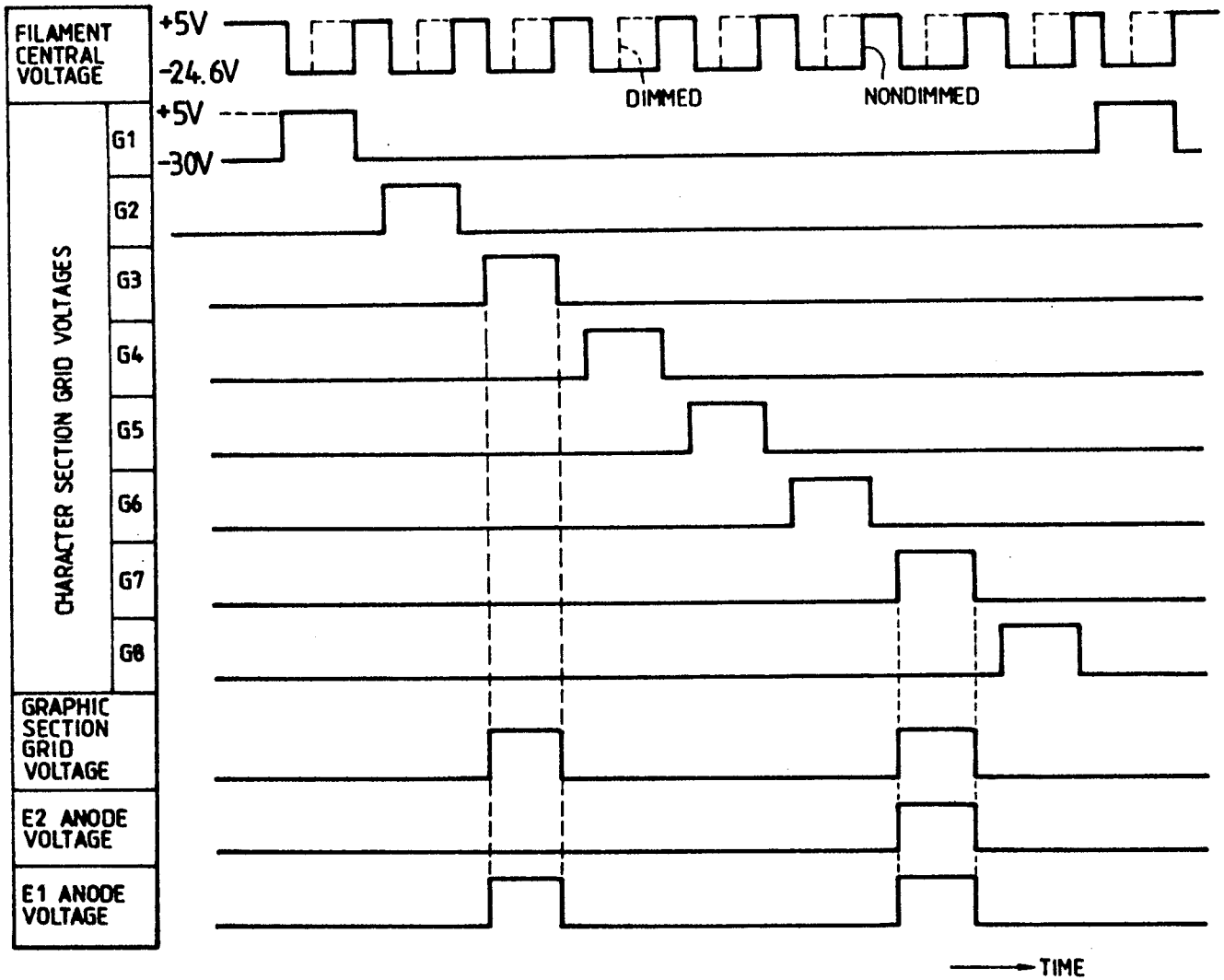
FIG. 2 is a timing diagram showing the waveforms of various signals in the fluorescent indicator apparatus of FIG. 1.

A grid control circuit 3 sequentially outputs voltage drive pulses G1–G8 to the grids X1–X8 of the dot matrixes C1–C8. The voltage pulses G1–G8 have a peak level of +5 V. As shown in FIG. 2, the voltage pulses G1–G8 are generated sequentially at equal time intervals. In addition, the grid control circuit 3 outputs a rectangular-wave signal B to a central processing unit (CPU) 18 and a segment decoder driver (SDD) circuit 2. The signal B includes a train of pulses synchronous with the voltage pulses G1–G8.

The CPU 18 outputs a character data signal to the SDD circuit 2. It should be noted that a connection between the CPU 18 and the SDD circuit 2 for the transmission of the character data signal is omitted from FIG. 1. The character data signal represents information such as a character to be indicated by one of the dot matrixes C1–C8 which is currently subjected to one of the voltage pulses G1–G8.

The SDD circuit 2 generates voltage drive pulses S1–S35 at a timing determined by the signal B in accordance with the character data signal fed from the CPU 18. The voltage pulses S1–S35 have a peak level of +5 V. The voltage pulses S1–S35 are applied to the respective anode segments of the dot matrixes C1–C8 so that the character represented by the character data signal can be indicated by one of the dot matrixes C1–C8 which is currently subjected to one of the voltage pulses G1–G8.

The grid control circuit 3 and the SDD circuit 2 are formed by a common integrated circuit (IC) chip such as a general-purpose IC chip "μPD6329" made by NEC Corporation.

An SDD circuit 5*a* generates voltage drive pulses P1–Pn in accordance with a graphic data signal outputted from the CPU 18. The voltage pulses P1–Pn have a peak level of +5 V. The voltage pulses P1–Pn are applied to respective anode segments t1–tn of the R/B portion E1 of the graphic display section 1*c*. In addition, an SDD circuit 5*b* generates voltage drive pulses Q1–Qn in accordance with a graphic data signal outputted from the CPU 18. The voltage pulses Q1–Qn have a peak level of +5 V. The voltage pulses Q1–Qn are applied to respective anode segments u1–un of the B/G portion of the graphic display section 1*c*. The SDD circuits 5*a* and 5*b* are formed by a common IC chip such an IC chip "μPD6300C" made by NEC Corporation. It should be noted that connections between the CPU 18 and the SDD circuits 5a and 5b for the transmission of the graphic data signals are omitted from FIG. 1.

In FIG. 1, the arrows starting from the CPU 18 and the arrows terminating at the SDD circuits 2, 5a, and 5b denote the character data signal and the graphic data signals transmitted between these devices.

A sync control circuit 4 receives the pulse signals G3 and G7 which are outputted from the grid control circuit 3. The sync control circuit 4 outputs voltage drive pulses to a grid 20 of the graphic display section 1c in synchronism with the pulse signals G3 and G7.

Figure 3:
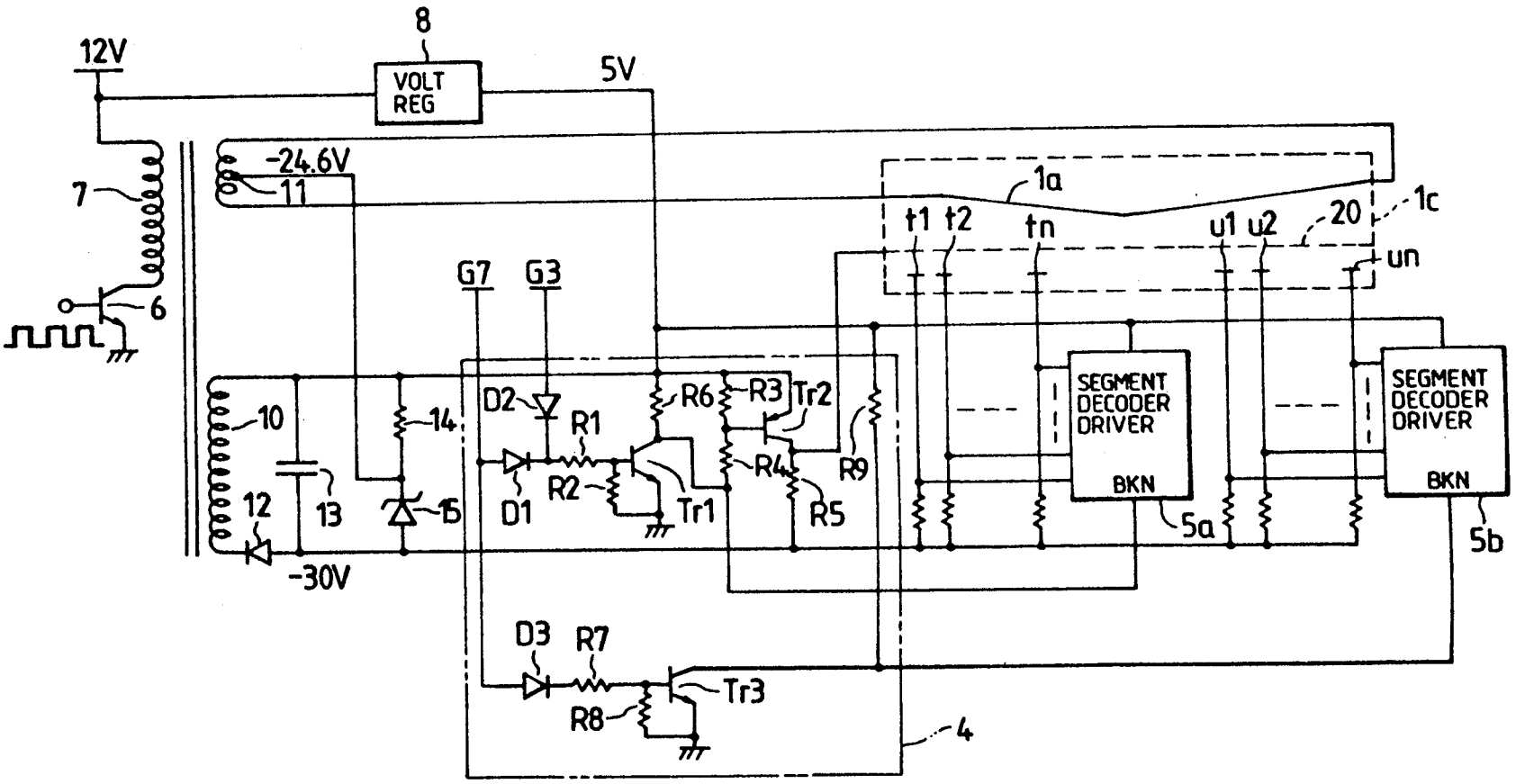
FIG. 3 is a schematic diagram of a graphic display part of the fluorescent indicator apparatus of FIG. 1.

As shown in FIG. 3, the sync control circuit 4 is composed of a switching circuit including NPN transistors Tr1 and Tr3 and a PNP transistor Tr2. The pulse signal G3 is applied to the base of the transistor Tr1 via a protective diode D2 and a base resistor R1. The base of the transistor Tr1 is grounded via a base leak resistor R2. The emitter of the transistor Tr1 is directly grounded. The collector of the transistor Tr1 is connected to the SDD circuit 5a. The collector of the transistor Tr1 is also connected to a positive dc power supply line via a pull-up resistor R6. The base of the transistor Tr2 is connected to the collector of the transistor Tr1 via a base resistor R4. The base of the transistor Tr2 is connected to the positive dc power supply line via a base leak resistor R3. The emitter of the transistor Tr2 is directly connected to the positive dc power supply line. The collector of the transistor Tr2 is connected to the grid 20 of the graphic display section 1c. The collector of the transistor Tr2 is also connected to a negative dc power supply line via a pull-down resistor R5. The pulse signal G7 is applied to the base of the transistor Tr1 via a protective diode D1 and the base resistor R1. The pulse signal G7 is applied to the base of the transistor Tr3 via a protective diode D3 and a base resistor R7. The base of the transistor Tr3 is grounded via a base leak resistor R8. The emitter of the transistor Tr3 is directly grounded. The collector of the transistor Tr3 is directly grounded. The collector of the transistor Tr3 is connected to the SDD circuit 5b. The collector of the transistor Tr3 is also connected to the positive dc power supply line via a pull-up resistor R9.

The circuits 2, 3, 4, 5a, and 5b are supplied with a positive power supply voltage of +5 V and a negative power supply voltage of −30 V. Grounding terminals of these circuits 2, 3, 4, 5a and 5b are grounded. As shown in FIG. 2, the filament 1a is subjected to a fixed-frequency rectangular-wave voltage whose central level equals −24.6 V or +5 V.

With reference to FIG. 1, the positive terminal of a 12-V vehicle battery (not shown) is connected to one end of a primary winding 7 of a transformer, and a voltage regulator 8. It should be noted that the negative terminal of the vehicle battery is grounded. The other end of the winding 7 is grounded via the emitter-collector path of a switching transistor 6. The current through the winding 7 is periodically allowed and inhibited by the transistor 6 in response to a fixed-frequency pulse signal applied to the base of the transistor 6. As a result, an alternating voltages are induced across secondary windings 10 and 11 of the transformer. The difference between the highest level and the lowest level of the alternating voltage across the winding 10 is about 35 V. The alternating voltage across the winding 10 is covered into a dc voltage by a combination of a rectifying diode 12 and a smoothing capacitor 13. The potential at one output terminal of the combination of the diode 12 and the capacitor 13 is held +5 V by the voltage regulator 8. The potential at the other output terminal of the combination of the diode 12 and the capacitor 13 is −30 V.

The potentials of +5 V and −30 V are applied to opposite ends of a series combination of a resistor 14, a voltage reference diode 15, and an NPN transistor 16 respectively. The transistor 16 is connected to a PNP transistor 17. The CPU 18 outputs a pulse signal A to the base of the transistor 17, thereby switching the transistor 17 in response to the pulse signal A. The pulse signal A is synchronous with the pulse signal B. The transistor 16 is periodically made conductive and nonconductive in accordance with the switching operation of the transistor 17. The voltage reference diode 15 is connected to a center tap of the secondary winding 11 of the transformer. The filament 1a is connected across the winding 11.

When the transistor 16 is conductive, the center tap of the winding 11 assumes a potential of −24.6 V since the Zener voltage of the voltage reference diode 15 is set 5.4 V. In this case, the filament 1a is supplied from the winding 11 with a voltage whose level varies in the range of about ±1.5 V around −24.6 V.

When the transistor 16 is nonconductive, the current through the resistor 14 and the voltage reference diode 15 is cut off so that the center tap of the winding 11 assumes a potential of +5 V. In this case, the filament 1a is supplied from the winding 11 with a voltage whose level varies in the range of about ±1.5 V around +5 V.

The grid control circuit 3 changes the applied voltages of the grids X1–X8 of the dot matrixes C1–C8 between −30 V and +5 V. As shown in FIG. 2, the grid control circuit 3 sequentially outputs the pulse voltages G1–G8 of +5 V to the grids X1–X8 of the dot matrixes C1–C8, so that the grids X1–X8 are driven by the pulse voltages G1–G8 in a time-division manner or a dynamic drive manner. The SDD circuit 2 changes the applied voltages of the anode segments of the dot matrixes C1–C8 between −30 V and +5 V. For example, when the grid X1 of the dot matrix C1 is subjected to the pule voltage G1 and simultaneously the anode segments Sa1–Sa35 of the dot matrix C1 are subjected to +5 V, fluorescent members in the anode segments generate light by electrons emitted from the filament 1a. The other dot matrixes C2–C8 function similarly.

The SDD circuit 2 has a blanking (BKN) terminal. Only when the BKN terminal of the SDD circuit 2 receives 0 V, the SDD circuit 2 is allowed to output the voltage of +5 V to the anode segments of the dot matrixes C1–C8. The BKN terminal of the SDD circuit 2 is periodically subjected to 0 V by the grid control circuit 3 in synchronism with the time-division drive of the grids X1–X8 of the dot matrixes C1–C8.

As described previously, the pulse signals G3 and G7 are applied to the sync control circuit 4 in addition to the dot matrixes C3 and C7. As shown in FIG. 2, the sync control circuit 4 outputs voltage drive pulses to the grid 20 of the graphic display section 1c in synchronism with the application of the voltage pulses G3 and G7 to the grids X3 and X7 of the dot matrixes C3 and C7. As described previously, the graphic display section 1c includes an R/B light emitting portion E1 generating red brown light and a B/G light emitting portion E2 generating blue green light. The luminous efficiency of a fluorescent member of the R/B portion E1 is lower than that of a fluorescent member of the B/G portion E2. The luminous efficiencies of the fluorescent members of the R/B portion E1 and the B/G portion E2 are determined by the luminances or brightnesses of the fluorescent members which occur when the R/B portion E1 and the B/G portion E2 are driven under the same conditions.

If the R/B portion E1 and the B/G portion E2 are driven by signals having the same duty factor, the B/G portion E2 would be generally brighter than the R/B portion E1 due to the above-mentioned difference in luminous efficiency. Such a problem is compensated in the following way. The SDD circuits 5a and 5b have blanking (BKN) terminals as the SDD circuit 2 has. The function of the BKN terminal of the SDD circuits 5a and 5b is similar to that of the BKN terminal of the SDD circuit 2. The sync control circuit 4 applies a potential of 0 V to the BKN terminal of the SDD circuit 5a in synchronism with the drive of the dot matrixes C3 and C7. Accordingly, as shown in FIG. 2, the SDD circuit 5a is enabled to output the voltage pulses P1–Pn to the anode segments t1–tn of the R/B portion E1 in synchronism with the drive of the dot matrixes C3 and C7. The sync control circuit 4 applies a potential of 0 V to the BKN terminal of the SDD circuit 5b in synchronism with the drive of only the dot matrix C7. Accordingly, as shown in FIG. 2, the SDD circuit 5b is enabled to output the voltage pulses Q1–Qn to the anode segments u1–un of the B/G portion E2 in synchronism with the drive of only the dot matrix C7.

The operation of the circuits 4, 5a, and 5b will be further described. With reference to FIG. 3, when the grid control circuit 3 (see FIG. 1) outputs the voltage pulses G3 and G7 of +5 V to the grids X3 and X7 of the dot matrixes C3 and C7, the voltage pulses G3 and G7 are also transmitted to the base of the transistor Tr1 so that a base current flows through the transistor Tr1 via the diodes D1 and D2 and the resistor R1. The base current makes the transistor Tr1 conductive, and the collector voltage of the transistor Tr2 becomes higher than the base voltage of the transistor Tr2 so that the transistor Tr2 is also made conductive. At this moment, the voltage of the grid 20 equals +5 V and the voltage of the BKN terminal of the SDD circuit 5a equals 0 V. Therefore, the voltage pulses are applied to the grid 20 of the graphic display section 1c and the anode segments t1–tn of the R/B portion E1 in synchronism with the drive of the dot matrixes C3 and C7. The application of these voltage pulses allows the fluorescent members in the anode segments t1–tn to emit red brown light.

When the grid control circuit 3 (see FIG. 1) outputs the voltage pulse G7 of +5 V to the grid X7 of the dot matrix C7, the voltage pulse G7 is also transmitted to the base of the transistor Tr3 so that a base current flows through the transistor Tr3 via the diode D3 and the resistor R7. The base current makes the transistor Tr3 conductive, and the voltage of the BKN terminal of the SDD circuit 5b becomes 0 V. Therefore, the voltage pulses are applied to the anode segments u1–un of the B/G portion E2 in synchronism with the drive of only the dot matrix C7. The application of these voltage pulses allows the fluorescent members in the anode segments u1–un to emit blue green light.

In this way, the duty factor of the drive signal of the B/G portion E2 of a higher luminous efficiency is set smaller than the duty factor of the drive signal of the R/B portion E1 of a lower luminous efficiency so that the brightnesses of the B/G portion E2 and the R/B portion E1 can be substantially similar. This design allows an acceptable agreement between the brightnesses of the character display section 1b and the graphic display section 1c.

Figure 4:
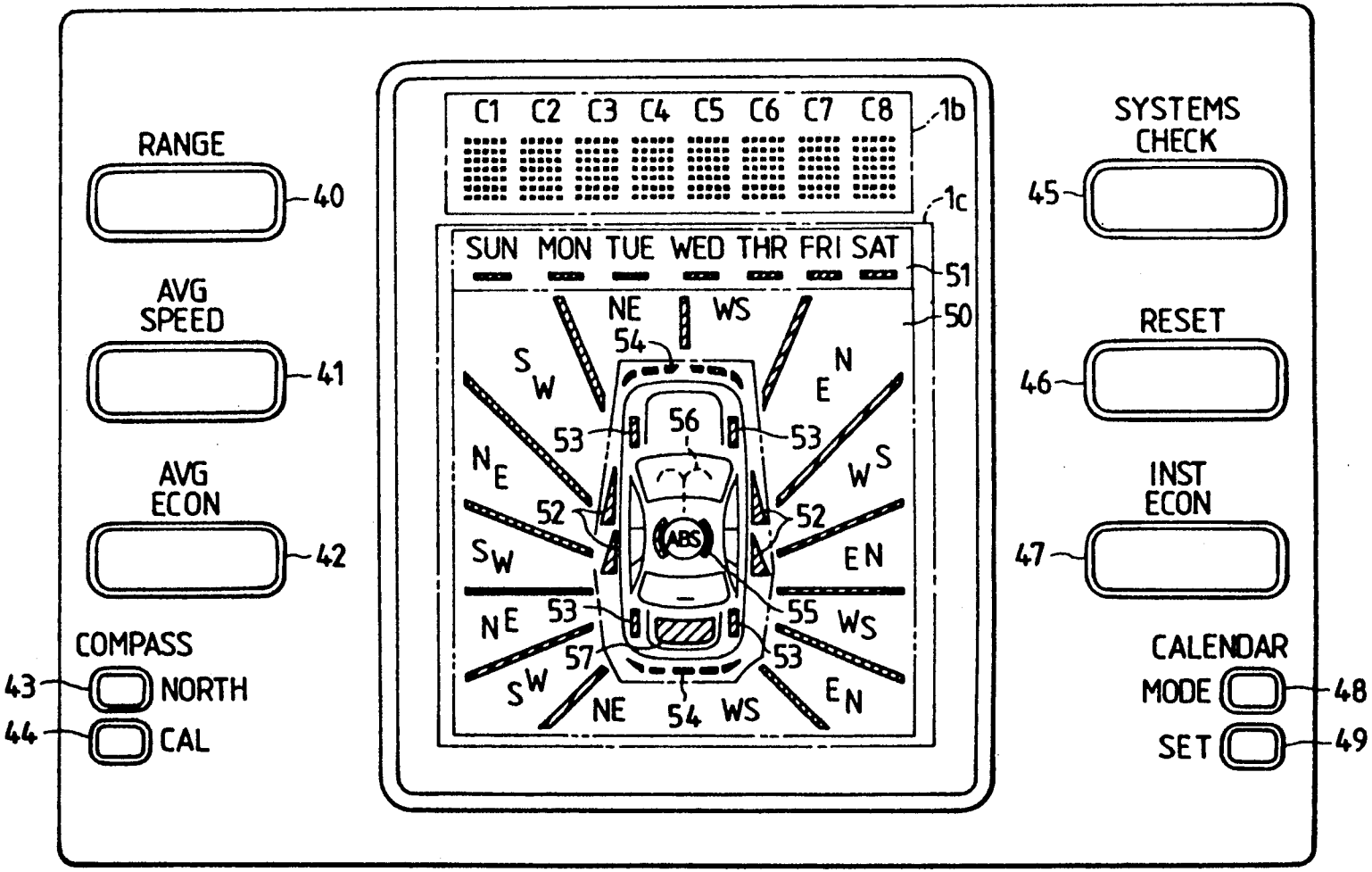
FIG. 4 is a plan view of a display front face of the fluorescent indicator apparatus of FIG. 1.

As shown in FIG. 4, the dot matrixes C1–C8 of the character display section 1b are located at an upper portion of a display front face 100. The dot matrixes C1–C8 are designed to indicate numerals and letters representing information such as an average vehicle speed, an average fuel economy or fuel consumption, or a date. The graphic display section 1c is located at a central portion and a lower portion of the display front face 100. The graphic display section 1c is designed to indicate information such as a vehicle travel direction, an incomplete closing of a vehicle door, or a break of a vehicle light. In the graphic display section 1c, door portions 52, tire portions 53, light portions 54, an ABS (antilock brake system) portion 55, and a trunk portion 57 are composed of the R/B portion E1 so that they emit red brown light and that they are driven in synchronism with the drive of the dot matrixes C3 and C7 of the character display section 1b. A washer portion 56, and other portions 50 and 51 of the graphic display section 1c are composed of the B/G portion E2 so that they emit blue green light and that they are driven in synchronism with the drive of only the dot matrix C7 of the character display section 1b.

The fluorescent indicator apparatus of this embodiment has various functions such as a trip function indicating vehicle travelling information, a compass function indicating a vehicle travel direction, a calendar function indicating a date, a service monitor function indicating a time of oil change, and a warning function indicating a break of a vehicle light.

In the trip function, a distance which can be travelled by the vehicle, an average vehicle speed, an average fuel consumption, and an instantaneous fuel consumption in unit of 1 second are indicated on the character display section 1b by actuating a "RANGE" switch 40, an "AVG SPEED" switch 41, an "AVG ECON" switch 42, and an "INST ECON" switch 47 respectively. These pieces of the vehicle travelling information are calculated on the basis of a reference starting time which coincides with the moment of actuation of a "RESET" switch 46.

In the compass function, the vehicle travel direction is indicated as one of 16 different directions on the direction portions 50 of the graphic display section 1c. A drift angle correction is started by actuating a "NORTH" switch 43. A magnetization correction is started by actuating a "CAL" switch 44.

In the calendar function, a year, a month, a day, and a time are indicated on the character display section 1b. These indications are changed by actuating a "MODE" switch 48, and are set to an arbitrary year, an arbitrary month, an arbitrary day, and an arbitrary time by actuating a "SET" switch 49. A day of the week is indicated on the portion 51 of the graphic display section 1c.

In the service monitor function, a time of oil change, a time of the change of an oil filter, a time of the change of an air filter, a time of tire rotation, and a time of vehicle check are sequentially indicated in numerals and letters on the character display section 1b at predetermined periods.

In the warning function, a door portion 52 is activated to emit red brown light when the related vehicle door is incompletely closed. A light portion 54 is activated to emit red brown light when the related vehicle light breaks. The tire portions 53 and the ABS portion 55 are activated to emit red brown light when the ABS system is wrong. The washer portion 56 is activated to emit blue green light when the quantity of the remaining washer liquid becomes small. The trunk portion 57 is activated to emit red brown light when the vehicle trunk is open.

Figure 5:
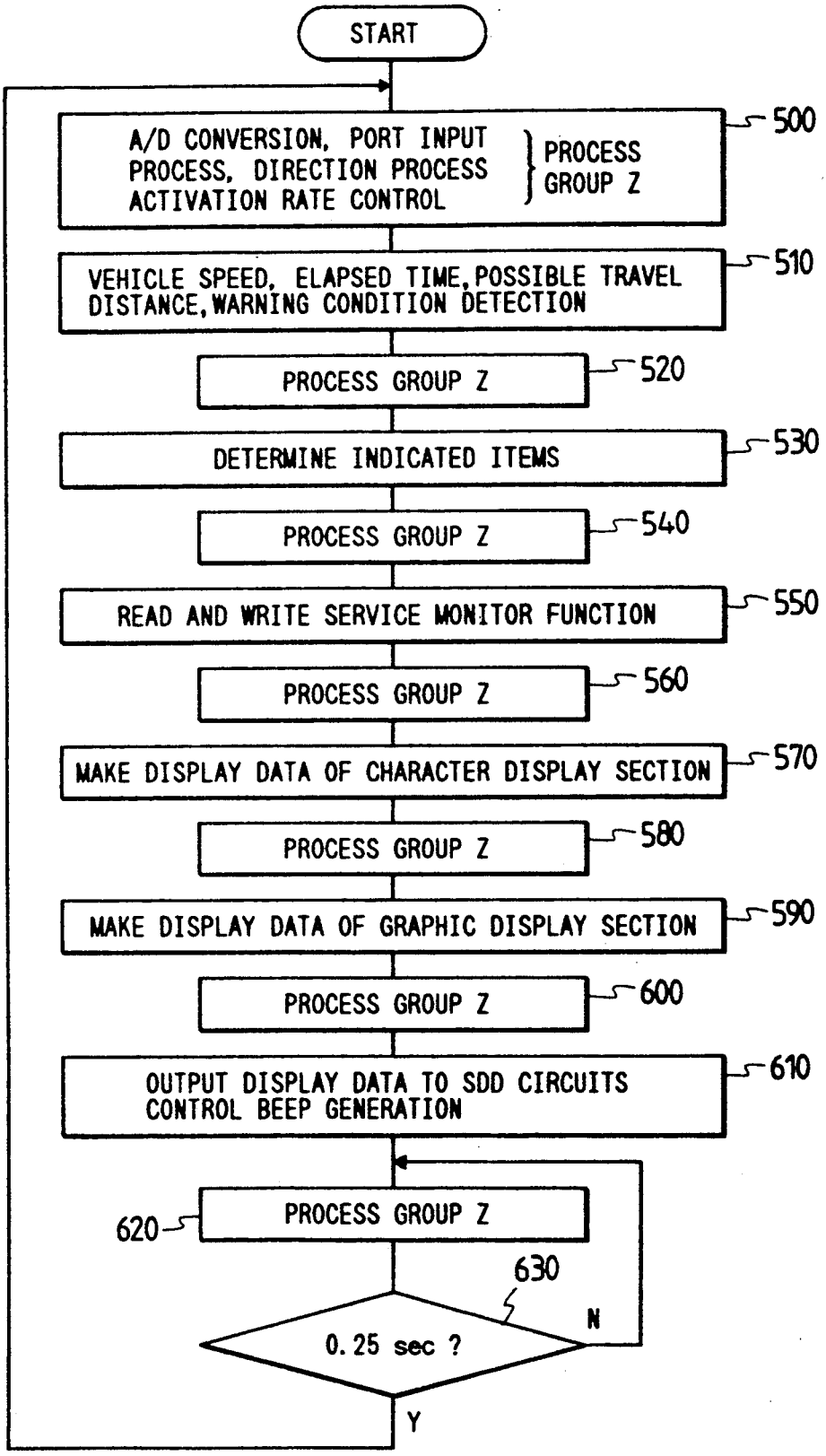
FIG. 5 is a flowchart of a main routine of a program operating the electronic control unit of FIG. 1.

The indication of information on the character display section 1*b* and the graphic display section 1*c* is controlled by the CPU 18 of FIG. 1. The CPU 18 forms a microcomputer having a combination of an input/output (I/O) circuit, a processing section, a read only memory (ROM), a general random access memory (RAM), and a non-volatile RAM. The I/O circuit includes analog-to-digital (A/D) converters. The CPU 18 operates in accordance with a program stored in the ROM. FIG. 5 shows a flowchart of a main routine of this program.

As shown in FIG. 5, a first step 500 of the program performs a group Z of various processes. Specifically, the step 500 performs an A/D conversion of a dimming rate setting signal fed from a rheostat (not shown), and performs a port inputting process of signals fed from various sensors (not shown) such as a vehicle speed sensor and a fuel level sensor, so that the input signals are converted into signals which can be processed in an internal portion of the CPU 18. The step 500 performs a key scan process to detect whether or not the various switches on the display front face 100 are actuated. Then, the step 500 performs a direction process to detect a vehicle travel direction and performs control of the activation rate of the fluorescent indicator tube 1 to adjust the brightnesses of the character display section 1*b* and the graphic display section 1*c* of the tube 1. The activation rate control will be described in detail hereafter.

A step 510 following the step 500 calculates a vehicle speed and measures an elapsed time. As will be made clear hereinafter, the main routine is periodically executed at intervals of 0.25 seconds. Accordingly, an elapsed time can be measured by counting the number of times of the execution of the step 510. For example, four times of the execution of the step 510 corresponds to an elapsed time of 1 second. The step 510 calculates a distance which can be travelled by the vehicle on the basis of a quantity of remaining fuel and an average fuel consumption. The step 510 detects conditions where the warning function should perform warning indications.

A step 520 following the step 510 performs the same process group Z as that executed by the previous step 500. This design is made in consideration of the following fact. Since the main routine is periodically executed at intervals of 0.25 second, the indicated information would have a considerable time lag with respect to the actual information if the process group Z is executed only once in the main routine. As will be made clear hereafter, the process group Z is generally executed eight times in the main routine so that the period of the execution of the process group Z is 31.25 ms.

A step 530 following the step 520 determines items to be indicated on the basis of the actuation of the switches detected by the step 500 and the warning conditions detected by the step 510.

A step 540 following the step 530 performs the process group Z as the step 510 does. After the step 540, the program advances to a step 550.

The step 550 writes and reads indication data of the service monitor function into and from the non-volatile RAM. The non-volatile RAM holds the indication data of the service monitor function even when a power supply to the CPU 18 is turned off.

A step 560 following the step 550 performs the process group Z as the step 510 does. After the step 560, the program advances to a step 570.

The step 570 generates indication data of the character display section 1*b* in accordance with the indication items determined by the previous step 530.

A step 580 following the step 570 performs the process group Z as the step 510 does. After the step 580, the program advances to a step 590.

The step 590 generates indication data of the graphic display section 1*c* in accordance with the indication items determined by the previous step 530.

A step 600 following the step 590 performs the process group Z as the step 510 does. After the step 600, the program advances to a step 610.

The step 610 outputs the indication data, which are generated by the previous steps 570 and 590, to the SDD circuits 2, 5*a*, and 5*b*. In addition, in the case where the warning indication is performed on the graphic display section 1*c*, the step 610 activates a sound generator (not shown) to produce a beep. After the step 610, the program advances to a step 620.

The step 620 performs the process group Z as the step 510 does. After the step 620, the program advances to a step 630.

The step 620 determines whether or not a time of 0.25 second has elapsed from the moment of the previous execution cycle of the main routine. When the time of 0.25 second has not elapsed, the program returns to the step 620. When the time of 0.25 second has elapsed, the current execution of the main routine ends and the program returns to the step 500.

The display front face 100 of FIG. 4 is generally placed in the interior of the vehicle within the field of view of a vehicle driver. It is preferable that the display brightness is high during the daytime and is low during the nighttime. In this embodiment, this function is realized as follows.

As shown in FIG. 1, the CPU 18 is informed by a lighting signal that the vehicle driver turns the vehicle headlights on. When the CPU 18 is informed of the activation of the vehicle headlights, the CPU 18 controls the pulse width of the signal A and thereby adjusts the display brightness in accordance with the dimming rate setting signal fed from the rheostat.

Figure 6A:
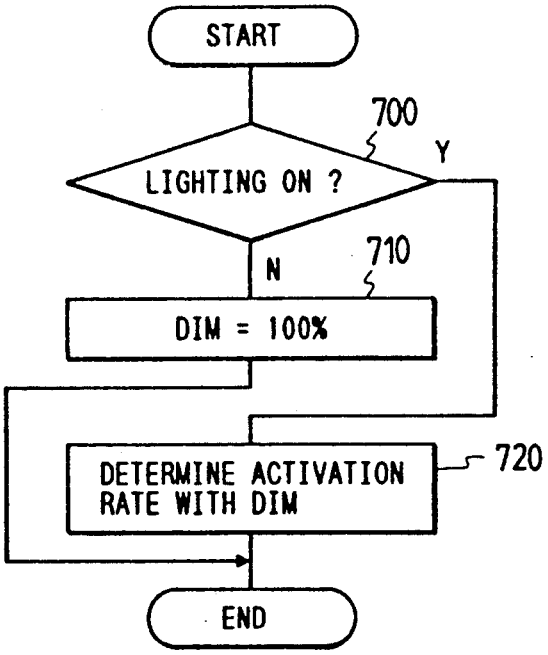
FIGS. 6(*a*), 6(*b*), and 6(*c*) are flowcharts of sub routines of the program operating the electronic control unit of FIG. 1.
Figure 6B:
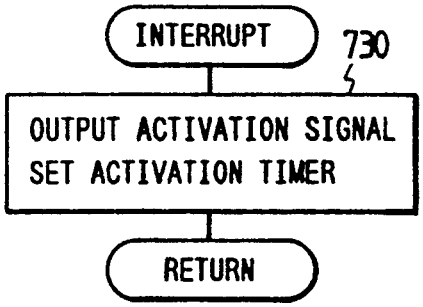
Figure 6C:
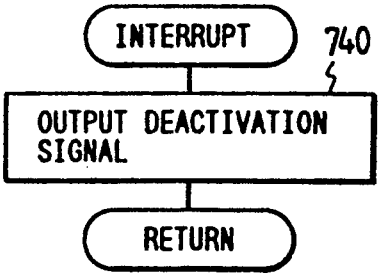

The control of the display brightness will be described in more detail hereafter. The control of the display brightness is realized by one process of the process group Z executed by each of the steps 500, 520, 540, 560, 580, 600, and 620 of FIG. 5. Accordingly, each of these steps 500, 520, 540, 560, 580, 600, and 620 includes a sub program executing the control of the display brightness. FIG. 6(*a*) is a flowchart of this sub program.

As shown in FIG. 6(*a*), a first step 700 of the sub program detects whether a lighting signal is present or absent. When the lighting signal is absent, the program advances to a step 710. When the lighting signal is present, the program advances to a step 720.

The step 710 sets a desired activation rate DIM of the fluorescent indicator tube 1 to 100%. After the step 710, the current execution cycle of the program ends.

The step 720 determines the desired activation rate DIM of the fluorescent indicator tube 1 in accordance with the dimming rate setting signal. Specifically, the desired activation rate DIM increases as the dimming rate decreases. After the step 720, the current execution cycle of the program ends.

An interruption process starts a sub routine of FIG. 6(*b*) in synchronism with the rising edge of each pulse of the signal B. It should be noted that the signal B is synchronous with the signal A. As shown in FIG. 6(*b*), the sub routine has a single step 730 which supplies a base current to the transistor 17 and thus which makes the transistor 17 conductive. As described previously, when the transistor 17 is conductive, the central value of the voltage of the filament 1*a* is −24.6 V so that the fluorescent indicator tube 1 is enabled. In addition, the step 730 determines an activation time in accordance with the desired activation rate DIM given by the step 710 or 720. The step 730 sets the determined activation time in a timer within the CPU 18.

When the determined activation time has elapsed since the moment of setting of the activation time in the timer, an interruption process is triggered so that a sub routine of FIG. 6(*c*) is started. As shown in FIG. 6(*c*), the sub routine has a single step 740 which interrupts the the supply of the base current to the transistor 17 and thereby which makes the transistor 17 nonconductive. As described previously, when the transistor 17 is nonconductive, the central value of the voltage of the filament 1*a* is +5 V so that the fluorescent indicator tube 1 is deactivated.

In the case where the activation rate DIM of the fluorescent indicator tube 1 is 100%, as shown in FIG. 2, the central value of the voltage of the filament 1*a* is held −24.6 V for an interval equal to the period during which a voltage pulse of +5 V is applied to one of the grids X1–X8 of the dot matrixes C1–C8.

It should be noted that this embodiment may be modified in various ways. For example, in a first modification of this embodiment, the brightness of the graphic display section 1*c* is raised by allowing three or more of the grid control signals G1–G8 to trigger the sync control circuit 4. In a second modification of this embodiment, the grid control signals G3 and G7 are inputted into the sync control circuit 4 via timer circuits or differentiating circuits so that the pulse widths of the signals applied to the anode segments of the R/B portion E1 and the B/G portion E2 of the graphic display section 1*c* can be varied to finely adjust the brightnesses of the R/B portion E1 and the B/G portion E2. In a third modification of this embodiment, the R/B portion E1 and the B/G portion E2 of the graphic display section 1*c* have respective separate grids. In a fourth embodiment of this invention, the character display section 1*b* and the graphic display section 1*c* are provided in separate fluorescent indicator tubes respectively.

What is claimed is:

1. A fluorescent indicator apparatus comprising:

a first display section including a plurality of first-type light-emitting portions, each of which has a first luminous efficiency for emitting a first light;

first driving means for periodically driving each of the first-type light-emitting portions in a predetermined order so that each of the first-type light-emitting portions sequentially emits the first light;

synchronizing control means, connected to the first driving means, for producing a synchronizing control signal only while the first driving means drives at least two predetermined portions of the first-type light-emitting portions;

a second display section including a second-type light-emitting portion having a second luminous efficiency, which is lower than the first luminous efficiency, for emitting a second light; and second driving means, cocnnected to the synchronizing control means, for driving the second-type light-emitting portion in response to the synchronizing control signal so that a brightness of the second display section is substantially equal to that of the first display section.

2. A fluorescent indicator apparatus comprising:

a first display section including a plurality of first-type light-emitting portions, each of which has a first luminous efficiency for emitting a first light;

first driving means for periodically driving each of the first-type light-emitting portions in a predetermined order so that each of the first-type light emitting portions sequentially emits the first light;

synchronizing control means, cocnnected to the first driving means, for producing a first synchronizing control signal only while the first driving means drives a predetermined portion of the first-type light-emitting portions, and for producing a second synchronizing control signal only while the first driving means drives another predetermined portion of the first-type light-emitting portions;

a second display section including a second-type light-emitting portion for emitting a second light in accordance with a second luminous efficiency which is lower than the first luminous efficiency, and a third-type light-emitting portion for emitting a third light in accordance with a third luminous efficiency which is substantially equal to the first luminous efficiency; and second driving means, connected to the synchronizing control means, for driving the second-type light-emitting portion in response to the first and second synchronizing control signals, and for driving the third-type light-emitting portion in response to the second synchronizing control signal so that the brightness of the second display section is substantially equal to that of the first display section.

3. A fluorescent indicator apparatus comprising:

a first display section including a plurality of grids and a plurality of sets of anode segments, each segment having an equal first luminous efficiency for emitting a first light, wherein a plurality of first-type light-emitting portions are formed by the respective combinations of each grid and each set of the anode segments;

grid driving means for periodically driving the grids of the first display section in a predetermined order;

anode driving means for driving the anode segments of each set in synchronism with the driving of the grids so that each first-type light-emitting portion sequentially emits the first light;

synchronizing control means, connected to the grid driving means, for producing a synchronizing control signal only while the grid driving means drives at least two predetermined grids of the first display section;

a second display section including a second-type light-emitting portion formed by a grid and an anode segment, wherein the second-type light-emitting portion emits a second light in accordance with a second luminous efficiency which is lower than the first luminous efficiency; and second-type light-emitting portion driving means, connected to the synchronizing control means, for driving the grid and the anode segment of the second-type light-emitting portion in response to the synchronizing control signal so that a brightness of the second display section is substantially equal to that of the first display section.

4. A fluorescent indicator apparatus according to the claim 3 further comprising:

a filament for emitting electrons for causing said anode segments of said first and second display sections to emit the first light and the second light, respectively;

voltage applying means for applying a changeable voltage to the filament; and voltage control means, connected to the voltage applying means, for periodically changing the voltage to be applied to the filament so as to maintain a brightness balance over the first and second display sections.

5. A fluorescent indicator apparatus comprising:

a first display section including a plurality of grids and a plurality of sets of anode segments, each segment having an equal first luminous efficiency for emitting a first light, wherein a plurality of first-type emitting portions are formed by the respective combinations of each grid and each set of the anode segments;

grid driving means for periodically driving the grids of the first display section in a predetermined order;

anode driving means for driving the anode segments of each set in synchronism with the driving of the grids so that each first-type light-emitting portion sequentially emits the first light;

synchronizing control means, connected to the grid driving means, for producing a first synchronizing control signal only while the grid driving means drives a predetermined grid of the first display section, and for producing a second synchronizing control signal only while the grid driving means drives another predetermined grid of the first display section;

a second display section including a second-type light-emitting portion which is formed by a grid and an anode segment, and a third-type light-emitting portion which is formed by a grid and an anode segment, wherein the second-type light-emitting portion emits a second light in accordance with a second luminous efficiency which is lower than the first luminous efficiency, and wherein the third-type light-emitting portion emits a third light in accordance with a third luminous efficiency which is substantially equal to the first luminous efficiency; and second display section driving means, connected to the synchronizing control means, for driving the second-type light-emitting portion in synchronism with the first and second synchronizing control signals and for driving the third-type light-emitting portion in synchronism with the second synchronizing control signal so that a brightness of the second display section is substantially equal to that of the first display section.

6. A fluorescent indicator apparatus according to claim 5, further comprising:

a filament for emitting electrons for causing said anode segments of said first-type, second-type, and third-type light-emitting portions to emit the first light, second light and third light, respectively;

voltage applying means for applying a changeable voltage to the filament; and voltage control means, connected to the voltage applying means, for periodically changing the voltage to be applied to the filament so as to maintain a brightness balance over the first and second display sections.

* * * * *